US005468712A

United States Patent [19]

Minato et al.

[11] Patent Number: 5,468,712

[45] Date of Patent: Nov. 21, 1995

[54] THERMAL TRANSFER DYE IMAGE-RECEIVING SHEET

[75] Inventors: Toshihiro Minato; Masaru Kato, both of Tokyo; Kenji Yasuda, Yachiyo, all of Japan

[73] Assignee: Oji Paper Co., Ltd., Tokyo, Japan

[21] Appl. No.: 904,142

[22] Filed: Jun. 25, 1992

[30] Foreign Application Priority Data

Jul. 10, 1991 [JP] Japan ..... 3-170081

[51] Int. Cl.[6] ..... B41M 5/035; B41M 5/38

[52] U.S. Cl. ..... 503/227; 428/195; 428/206; 428/318.4; 428/328; 428/329; 428/330; 428/331; 428/474.4; 428/475.2; 428/476.9; 428/480; 428/483; 428/910; 428/913; 428/914

[58] Field of Search ..... 8/471; 428/195, 428/207, 318.4, 323, 328–331, 409, 480, 523, 913, 914, 206, 474.4, 475.2, 476.3, 476.9, 483, 910; 503/227

[56] References Cited

U.S. PATENT DOCUMENTS 4,774,224 9/1988 Campbell ..... 503/227
4,778,782 10/1988 Ito et al. ..... 503/227
5,001,106 3/1991 Egashira et al. ..... 503/227

FOREIGN PATENT DOCUMENTS

0409598A2 1/1991 European Pat. Off. ..... 503/227
61-164892 7/1986 Japan ..... 503/227
2217866A 11/1989 United Kingdom ..... 503/227

*Primary Examiner*—B. Hamilton Hess
*Attorney, Agent, or Firm*—Armstrong, Westerman, Hattori, McLeland & Naughton

[57] ABSTRACT

A thermal transfer dye image-receiving sheet capable of forming full color dye images with a high reproducibility at a high speed, and having a high resistance to curling in a thermal printing operation, comprises a dye image-receiving layer comprising a dye-receiving resin material and formed on a front surface of a substrate sheet, which substrate sheet front surface is formed from a biaxially oriented thermoplastic resin film having a number of fine voids, the front surface of the thermoplastic resin film, on which the dye image-receiving layer is formed, having a Bekk smoothness of 1000 seconds or more and a glossiness of 50% or less.

6 Claims, 1 Drawing Sheet

THERMAL TRANSFER DYE IMAGE-RECEIVING SHEET

BACKGROUND OF THE INVENTION

1. Field of the Invention

The present invention relates to a thermal transfer dye image-receiving sheet. More particularly, the present invention relates to a thermal transfer dye image-receiving sheet (hereinafter referred to as an image-receiving sheet) usable for a thermal imaging printer, especially a dye thermal transfer printer, and capable of printing thermally transferred continuous full-color dye images at a high speed with a high reproducibility, without a thermal curling thereof.

2. Description of the Related Art

Currently there is an enormous interest in the development of new types of thermal transfer dye printers capable of printing clear full colored images or pictures.

In the operation of the thermal transfer dye printers, an image receiving sheet having a image-receiving layer comprising a dye-dyeable resin is superimposed on a dye sheet having a sublimating dye layer, in such a manner that the image-receiving layer of the image-receiving sheet comes into contact with the sublimating dye layer of the dye sheet, and the dye sheet is locally heated imagewise by a thermal head in accordance with electric signals corresponding to the images or pictures to be printed, to thus thermally transfer the dye images or pictures having a color density corresponding to the amount of heat applied to the dye sheet superimposed on the image-receiving sheet.

It is known that a bi-axially oriented thermoplastic resin film comprising a thermoplastic resin, for example, a polyolefin resin, and having a plurality of fine voids or pores is used as a support sheet of an image-receiving sheet, to print thermally transferred dye images having a high picture quality on the image-receiving sheet at a high speed.

In the image receiving sheet, an image-receiving layer comprising, as a main component, a dyeable resin, is formed on the support sheet.

The image-receiving sheet having the above-mentioned support sheet is advantageous in that the resulting image-receiving sheet has a relatively high uniformity in the thickness thereof, and a high flexibility and a low heat-conductivity in comparison with that of a customary paper sheet comprising cellulose pulp fibers, and thus is beneficial in that the resultant thermally transferred dye images thereon are uniform and have a high color density.

Nevertheless, when the bi-axially oriented thermoplastic resin film is utilized as a support sheet of an image-receiving sheet which should exhibit a high reproducibility of the images, the support sheet is disadvantageous in that the void structure in the surface portion of the support sheet causes undesirable fine noise to be created in the recorded images. Also the bi-axially oriented thermoplastic resin film is disadvantageous in that, when thermally printed, the thermoplastic resin film is released from a residual orienting stress thereof created by the orienting process applied to the film and thus shrinks, and this shrinkage causes the image-receiving sheet to be curled or wrinkled. The curling and wrinkling hinder the smooth travel of the image-receiving sheets within the printer, and sometimes cause an undesirable blockage of the sheets.

To eliminate the above-mentioned disadvantages, i.e., creation of curls and wrinkles, attempts have been made to utilize a laminate sheet composed of a core sheet having a relatively small thermal shrinkage or a relatively high modulus of elasticity and oriented thermoplastic resin film layers laminated on the two surfaces of the core sheet, as a support sheet of an image-receiving sheet. Such an attempt is disclosed in U.S. Pat. No. 4,774,224. This type of support sheet, however, is disadvantageous in that the price thereof is too high, and in that since the two laminated film layers each have a different thermal shrinkage rate, the resultant image-receiving sheet is not completely free from a curling thereof due to the difference in the thermal shrinkage of the two laminated film layers when heated.

Also, to eliminate the fine noise from the recorded images, an attempt has been made to utilize, as a support sheet, an oriented film having a high surface smoothness or a laminated composite film prepared therefrom. This attempt is disclosed in U.S. Pat. No. 4,778,782.

The high smoothness film unavoidably exhibits a high glossiness, and thus when the high smoothness film is used as a support sheet of an image-receiving sheet, the resultant images received on the image-receiving sheet exhibit an unnatural glossiness, i.e., an undesirable glitter appearance, and thus have a low value as high reproduction quality images.

Furthermore, since the thermal dye transfer printer is used for full color printing and for video printing, in which the dye images are transferred by a large amount of heat, the image-receiving sheet must record clear images thereon, without a thermal curling and wrinkling, and be able to be industrially supplied under stable conditions.

SUMMARY OF THE INVENTION

An object of the present invention is to provide a thermal transfer dye image-receiving sheet applicable to various types of thermal transfer dye printers and capable of recording clear dye images thereon with a high reproducibility and at a high printing efficiency.

Another object of the present invention is to provide a thermal transfer dye image-receiving sheet substantially free from the disadvantages of a conventional thermal transfer dye image-receiving sheet having, as a support sheet, a bi-axially oriented, void-containing thermoplastic resin film.

The inventors of the present invention have discovered that a specific substrate sheet having a front surface formed by a biaxially oriented thermoplastic resin film comprising, as a main component, a mixture of a thermoplastic resin with a filler, provided with a void structure and having a surface smoothness and a glossiness controlled to specific values, is useful for providing a thermal transfer dye image-receiving sheet having an image-receiving layer formed on the substrate sheet and having a satisfactory transparency and an excellent dye-receiving performance. The present invention is based on this discovery.

Namely, the above-mentioned objects can be attained by the thermal transfer dye image-receiving sheet of the present invention comprising:

a substrate sheet;

a dye image-receiving layer formed on a surface of the substrate sheet and comprising a dye-receiving resin material, a front surface of the substrate sheet, on which the dye image receiving layer is formed, being formed from a biaxially oriented thermoplastic resin film comprising a mixture of a thermoplastic resin with a filler and provided with a void structure; and the front surface of the thermoplastic resin film, on which the dye image-receiving layer is formed, having a Bekk smoothness of 1000 seconds or more and a glossiness of 50% or less.

DESCRIPTION OF THE PREFERRED EMBODIMENTS

Figure 1:
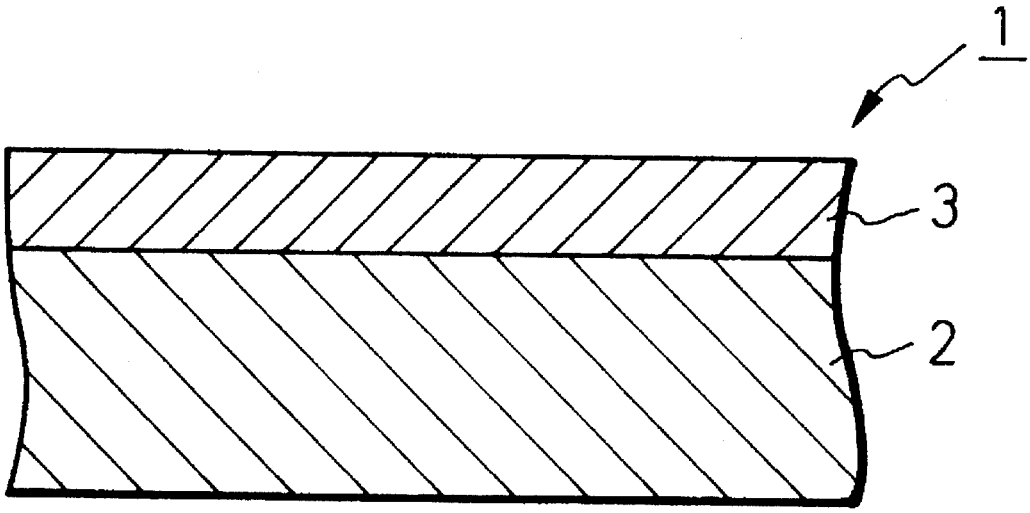
FIG. 1 is an explanatory cross-sectional profile of an embodiment of the thermal transfer dye image-receiving sheet of the present invention; and, FIG. 2 is an explanatory cross-sectional profile of another embodiment of the thermal transfer dye image-receiving sheet of the present invention.

It is known that a conventional oriented thermoplastic film comprising, as a main component, a thermoplastic resin, for example, a polyolefin resin, and having a void structure, usually has a Bekk smoothness of 100 to 600 seconds determined by an Ohken type smoothness tester, because the thermoplastic film is used as a synthetic paper sheet, and thus is provided with a void structure necessary to impart a paper-like surface structure and an enhanced writing property and printing property to the thermoplastic film. Accordingly, the conventional oriented thermoplastic film surface has a low smoothness.

In the present invention, the term "void structure" refers to an isolated void structure in which a number of fine voids are distributed separately from each other in a matrix comprising a mixture of a thermoplastic resin with a filler.

The inventors of the present invention discovered that, to improve the reproducibility of the thermally transferred dye images, it is necessary to enhance the surface smoothness of the substrate sheet to a specific level or higher.

As mentioned above, in the conventional oriented thermoplastic film having a void structure, it is known that the higher the surface smoothness, the higher the glossiness of the surface.

In the present invention, it has been found that, when the glossiness of the substrate sheet surface on which the dye image-receiving layer is arranged is controlled to a level of 50% or less, which is determined by ASTM D 523-80 (JIS Z 8741), 60 degree reflection method, the undesirable unnatural gloss on the non-image formed portion and printed images can be avoided.

In the dye image-receiving sheet of the present invention, the reproducibility of the recorded images is enhanced by an increase in the smoothness of the front surface of the substrate sheet. Usually, a Bekk smoothness of 1000 seconds or more is high enough to impart a satisfactory reproducibility of the images to the dye image-receiving sheet, but if a very high resolving power and reproducibility of the images is required, preferably the Bekk smoothness of the front surface the substrate sheet is 3000 seconds or more.

As mentioned above, in the dye image-receiving sheet of the present invention, the glossiness of the front surface of the substrate sheet must be controlled to a level of 50% or less, as determined by the 60 degree reflection method, JIS Z 8741. If the glossiness is more than 50%, the front surface of the resultant dye image-receiving sheet exhibits an unnatural glitter, and sometimes undesirable patterns are generated on the front surface due to unevenness in the glossiness thereof.

Where the substrate sheet has a front surface glossiness of more than 50% but not more than 70% and the dye image-receiving layer has a transparency of 90% or less, the resultant image-receiving sheet surface sometimes does not show a significant unnatural glitter, but if the glossiness of the front surface of the substrate sheet is not even, undesirable patterns are generated on the image-receiving layer surface due to the uneven glossiness, and thus at some angles of observation undesirable noise is created in the recorded images.

The unevenness in the glossiness of the front surface of the dye image receiving sheet is generated due to uneven producing and processing conditions of the substrate sheet, but the generation of an uneven glossiness of the dye image-receiving sheet can be effectively avoided by controlling the glossiness of the front surface of the substrate sheet to a level of 50% or less.

In the present invention, the porosity of the biaxially oriented thermoplastic resin film is a ratio (in %) of the total volume of the voids to the apparent volume of the film, and can be obtained from a true specific gravity of the resin material from which the film is formed, and the apparent thickness of the film.

The porosity of the film has a large influence on the thermal insulating property and ability to be compressed, which in turn have a great influence on the quality of the thermally transferred dye images.

With respect to the porosity of the film, the inventors of the present invention found by experiment that the porosity of a surface portion of the substrate sheet having a depth of 5 to 30 μm from the surface has a greater influence on the resultant dye image quality and the sensitivity of the dye image-receiving layer than the porosity of the entire substrate sheet.

To obtain a high quality of the resultant dye images and a high resistance to curling of the resultant dye image-receiving sheet, the porosity of the surface portion of the substrate sheet must be 10% or more, preferably 20% or more. When the porosity is more than 40%, however, the resultant surface portion of the substrate sheet exhibits an unsatisfactory mechanical strength.

The biaxially oriented porous thermoplastic resin film usable for the present invention may be a single layer film having a uniform void structure, or be a multi-layer film having two or more layers.

For example, the multi-layer film may have a two-layer structure composed of a front layer and back layer, or a three-layer structure composed of a front layer, a core layer, and a back layer. The front layer of the above-mentioned multi-layer film must have the specific surface smoothness and glossiness as defined above, and preferably the specific porosity as mentioned above, to provide a dye image-receiving sheet of the present invention having a high reproducibility of the dye images. The substrate sheet may consist of a biaxially oriented porous thermoplastic resin film alone, which may be selected from single layer films and multi layer films, as mentioned above.

Referring to FIG. 1, a dye image-receiving sheet 1 comprises a substrate sheet 2, and a dye image-receiving layer 3 formed on a front surface of the substrate sheet 2.

Figure 2:
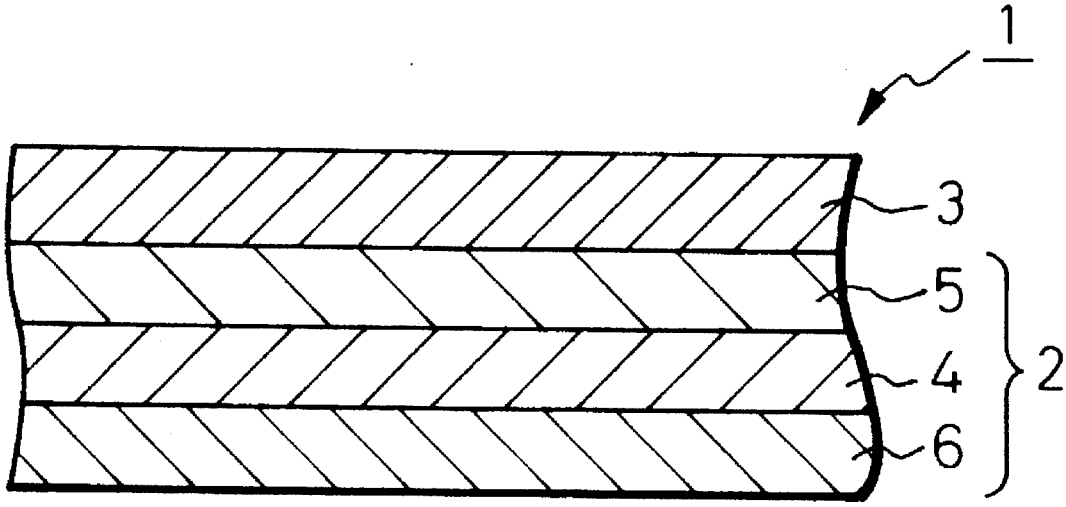

Referring to FIG. 2, a dye image-receiving sheet 1 comprises a substrate sheet 2 composed of a core layer 4, a front layer 5 formed on a front surface of the core layer 4, and a back layer 6 formed on a back surface of the core layer 4, and a dye image-receiving layer 3 formed on a front surface of the front layer 5.

Each of the front and back layers is preferably formed from a biaxially oriented porous thermoplastic resin film having a void structure. The core layer supports the front layer and back layer on the front and back surfaces thereof, and consists of a sheet material having a smaller thermal shrinkage of 0.1% or less at 100° C. or more, than that of the front and back layers, and selected from, for example, fine paper sheets, middle quality paper sheets, Japanese paper sheets, thin paper sheets, coated paper sheets, and synthetic polymer films, for example, polyester resin films and polyamide films.

In the production of the biaxially oriented porous thermoplastic film having a large number of fine voids separate from each other, a mixture of a thermoplastic resin with a filler consisting of at least one member selected from inorganic pigment, and a finely divided organic polymeric substance not compatible with the thermoplastic resin, is melted, the resultant melt is converted, by using a melt-extruder, to a single or multi-layer film, and the resultant film is biaxially oriented to provide an oriented film having a void structure. The porosity of the resultant oriented film varies depending on the type of the filler, the mixing ratio of the thermoplastic resin to the filler, and the drawing conditions.

The thermoplastic resin usable for producing the oriented film is preferably selected from polyolefin resins, for example, polyethylene and polypropylene resins, and polyester resins which have a high crystallinity and drawability and a satisfactory void (pore)-forming property, and a mixture of at least one of the above-mentioned resins with a small amount (preferably 30% by weight or less) of another thermoplastic resin.

The filler is contained in an amount of 2 to 30% by volume in a thermoplastic resin matrix. The porosity of the oriented film is increased with an increase in the content of the filler, but when the filler content is too high, the resultant oriented film exhibits an undesirably low mechanical strength and poor surface smoothness. Also, the resultant dye images are divided into small points, and thus exhibit a poor quality, and the film is easily broken.

The inorganic pigment usable as a filler preferably has an average particle size of 1 μm or more but not more than 20 μm, and is selected from calcium carbonate, clay, diatomaceous earth, titanium dioxide, aluminum trihydroxide and silica.

The polymeric substance not compatible in a thermoplastic resin matrix and usable as a filler is preferably a polypropylene resin for a polyester resin matrix or a polyester resin for a polyolefin resin matrix. Where the filler is contained in a small content in a thermoplastic resin matrix, and the resultant film has a high porosity and a high surface smoothness, the glossiness of the film surface is sometimes too high and uneven, and when a transparent dye image-receiving layer is formed on the above mentioned high filler film, the resultant dye image-receiving sheet sometimes exhibits an undesirable pearl-like or metallic glitter and an unnatural appearance.

The thermal shrinkage of the oriented film to be used for the dye image-receiving sheet of the present invention is preferably measured at a temperature equal to a heating temperature for printing. Customarily, the thermal shrinkage of each oriented film in the substrate sheet is represented by a value determined by heating the oriented film at a temperature of 100° C. to 130° C. for a time of from one second to 10 minutes.

The mono- or bi-axially oriented multi-layer porous thermoplastic films comprising a mixture of a polyolefin resin with an inorganic pigment are available as synthetic paper sheets, under the trademark of Yupo, from OJI Yuka Goseishi K.K., and are usually utilized as printing, writing and recording sheets.

Those oriented films have a three-layer structure composed of a core layer consisting of mono- or bi-axially oriented thermoplastic resin film and front and back paper-like thermoplastic resin layers formed on the front and back surfaces of the core layer or a four-layer structure composed of a core layer, front and back layers and an additional layer consisting of a mono- or bi-axially oriented thermoplastic resin film.

The dye image-receiving sheet of the present invention is provided by forming a dye image-receiving layer on a front surface of the substrate sheet. The dye image-receiving layer comprises, as a main component, a dye-receiving synthetic resin comprising a member selected from polyester resins, polycarbonate resins, polyvinyl chloride resins and other dyable synthetic resins.

The dye image-receiving layer optionally contains a resin cross-linking agent, lubricant, releasing agent and/or pigments, which effectively prevent a fuse-adhesion of the dye image-receiving layer to the dye ink sheet. Further, the dye image-receiving layer optionally contains a pigment, fluorescent brightening agent, blue or violet dye, ultraviolet ray-absorbing agent and/or antioxidant. The above-mentioned additive may be mixed into the thermoplastic resin matrix and coated on the substrate sheet, or separately coated on or under the dye image-receiving layer.

The dye image-receiving layer and another coating layer can be formed by applying a coating liquid by using a customary coater, for example, a bar coater, gravure coater, knife coater, blade coater, air knife coater, or gateroll coater, and drying the resultant coating liquid layer.

EXAMPLES

The present invention will be further explained with reference to the following examples.

In the examples, the dye image-receiving performance and the thermal curling resistance of the resultant dye image-receiving sheets were tested and evaluated in the following manner.

The dye image-receiving sheets were subjected to a thermal printing operation using a sublimating dye thermal transfer printer available under the trademark of Video Printer VY-P1, from HITACHI SEISAKUSHO.

1) Quality of images

The resultant images were observed by the naked eye and the clarity (sharpness) of the colored images, the evenness of the color density, and the glossiness of the images were evaluated in the classes as shown below.

| Class | Observation result |
|---|---|
| | i) Clarity of colored images |
| 3 | Clear and Sharp |
| 2 | Slightly unclear |
| 1 | Bad |
| | ii) Evenness of color density |
| 3 | Even |
| 2 | Slightly uneven |
| 1 | Uneven |

-continued

| Class | Observation result |
|---|---|
| | iii) Glossiness |
| 3 | No unnatural glitter |
| 2 | Local unnatural glitter |
| 1 | Significant unnatural glitter |

2) Resistance to curling by thermal printing operation

A dye image-receiving sheet having a length of 14 cm and a width of 10 cm was subjected to a close black printing operation all over the sheet. The printed sheet was placed on a horizontal plane so that the corners of the sheet were raised up from the horizontal plane, the heights of the corner ends from the horizontal plane, and a largest value of the heights was determined.

The resistance of the dye image-receiving sheet to curling was evaluated as follows.

| Class | Largest height |
|---|---|
| 3 | 0 |
| 2 | ≦10 mm |
| 1 | >10 mm |

Production Example 1 (Production of biaxially oriented porous polyolefin resin film (I))

A resin mixture was prepared by mixing 65% by weight of a polypropylene resin having a melt index (MI) of 0.8 with 15% by weight of a low density polyethylene resin and 20% by weight of particulate calcium carbonate having an average particle size of 3 μm.

The resin mixture was melt extruded through a film-forming die of a melt extruder at a temperature of 270° C. and the resultant film-shaped melt flow was cooled to solidify the melt.

The resultant undrawn film substantially did not contain voids (pores).

The undrawn film was biaxially drawn at a temperature of from 150° C. to 170° C. to provide a biaxially oriented porous polyolefin film having a void structure.

The film had a porosity of 25% and a number of voids were evenly distributed throughout the film, especially in the direction of the thickness of the film.

Also, the film had a Bekk smoothness of the front surface of 6000 seconds and a Bekk smoothness of the back surface of 2500 seconds determined by a Okken type smoothness tester and a glossiness of 75% at an angle of 60 degrees.

Production Example 2 (Production of biaxially oriented porous polyolefin resin film (II))

A mixture of 80% by weight of a polypropylene resin having a melt index (MI) of 0.8 with 20% by weight of a particulate calcium carbonate having an average particle size of 1.5 μm was kneaded and melt-extruded through a film-forming die of a melt extruder at a temperature of 270° C., cooled by a cooling apparatus to provide an undrawn film.

The undrawn film was heated at a temperature of 145° C. and drawn at this temperature in the longitudinal direction of the film at a draw ratio of 5.0 to provide an oriented core film.

Separately, a mixture of 50% by weight of a polypropylene resin having a melt index of 4.0 with 50% by weight of particulate calcium carbonate having an average particle size of 3 μm was melt-kneaded and extruded through a pair of film-forming dies to coat both the front and back surfaces of the oriented core film. The resultant three-layer sheet was heated at a temperature of 185° C. and drawn at this temperature at a draw ratio in the cross direction of the sheet. In the resultant three-layer sheet, the front layer, the core layer and the back layer had the thicknesses and the porosities as indicated below.

| Layer | Item: Thickness (μm) | Item: Porosity (%) |
|---|---|---|
| Front layer | 25 | 24 |
| Core layer | 100 | 12 |
| Back layer | 25 | 24 |

The front surface of the resultant three-layer film had a Bekk smoothness of 1400 seconds and a glossiness of 35% at an angle of 60 degrees.

Production Example 3 (Production of biaxially oriented porous polyolefin resin film (III))

An oriented polyolefin resin film having a three-layer structure was produced by the same procedures as in Example 2, except that the thicknesses of the front, core and back layers were 5 μm, 45 μm, and 5 μm.

The front surface of the resultant three-layer film had a Bekk smoothness of 1500 seconds and a glossiness of 30% at an angle of 60 degrees.

Example 1

The biaxially oriented polyolefin resin film (II) of Production Example 2 was used as a substrate sheet of a dye image-receiving sheet.

A front surface of the substrate sheet was coated with a coating resin composition-1 having a composition as shown below, to form a dye image-receiving layer having a dry weight of 5 g/m$^2$.

| Coating resin composition-1 Component | Part by weight |
|---|---|
| Polyester resin (Trademark: VYLON290, made by Toyobo K.K.) | 100 |
| Amino-modified silicone resin (Trademark: KF-393, made by Shinetsu Kagaku Co.) | 1.5 |
| Epoxy-modified silicone resin (Trademark: X-22-343, made by Shinetsu Kagaku Co.) | 1.5 |
| Toluene | 200 |
| Methylethylketone | 200 |

The resultant dye image-receiving sheet was subjected to the above-mentioned tests.

The test results are shown in Table 1.

Example 2

A substrate sheet was prepared by laminating each of front and back surfaces of a biaxially oriented polyethylene terephthalate film made by TEIJIN LTD. and having a thickness of 25 μm with the biaxially oriented porous polyolefin film (III) of production Example 3 by a dry lamination method.

A front surface of the resultant substrate sheet was coated with a coating resin composition-2 having the composition as indicated below, to form a dye image-receiving layer having a dry weight of 5 g/m$^2$.

| Coating resin composition-2 Component | Part by weight |
|---|---|
| Polyester resin (VYLON290) | 100 |
| Amino-modified silicone resin (KF-393) | 1.5 |
| Epoxy-modified silicone resin (X-22-343) | 1.5 |
| Cationic polyacrylic resin (Trademark: ST-2000, made by Mitsubishi Yuka Co.) | 1.0 |
| Toluene | 200 |
| Methylethylketone | 200 |

The resultant dye image-receiving sheet was subjected to the afore-mentioned tests, and the test results are shown in Table 1.

Comparative Example 1

The biaxially oriented porous polyolefine resin film (I) of Production Example 1 was used as a substrate sheet.

A front surface of the substrate sheet was coated with the coating resin composition-1 and dried to provide a dye image-receiving layer having a dry weight of 5 g/m$^2$.

The resultant dye image-receiving sheet was tested in the above-mentioned manner, and the test results are shown in Table 1.

Comparative Example 2

A substrate sheet was prepared by laminating the biaxially oriented porous polyolefin resin film (I) of Production Example 1 on each of front and back surfaces of a biaxially oriented polyethyleneterephthalate resin film made by Teijin Ltd., and having a thickness of 25 μm by a dry lamination method.

The front surface of the resultant substrate sheet was coated with the coating resin composition-2 and dried to provide a dye image-receiving layer having a dry weight of 5 g/m$^2$.

The resultant dye image-receiving sheet was tested in the above-mentioned manner, and the test results are shown in Table 1.

TABLE 1

| Example No. | | Item: Clarity of colored image | Evenness of color density | Gloss-iness | Curling resistance in thermal printing |
|---|---|---|---|---|---|
| Example | 1 | 3 | 3 | 3 | 3 |
| | 2 | 3 | 3 | 3 | 3 |
| Comparative | 1 | 3 | 2 | 1 | 1 |
| Example | 2 | 3 | 2 | 1 | 2 |

Table 1 clearly shows that the dye image-receiving sheet of Examples 1 and 2 in accordance with the present invention were satisfactory in all of the clarity of colored image, evenness of color density, glossiness, and resistance to curling, whereas the dye image-receiving sheet of Comparative Examples 1 and 2 were unsatisfactory in at least one of the above-mentioned items.

Therefore, it was confirmed that the dye image-receiving sheet of the present invention is useful for high quality thermal transfer printers.

We claim:

1. A thermal transfer dye image-receiving sheet comprising:

(1) a substrate sheet comprising:

(a) a core sheet comprising a member selected from the group consisting of polyester films and polyamide films, (b) a front layer formed on a front surface of the core sheet to provide a front surface of the substrate sheet and consisting of a biaxially oriented thermoplastic film comprising a mixture of a thermoplastic resin with a filler and provided with a void structure, and having a porosity of from 10% to 40%, and (c) a back layer formed on a back surface of the core sheet and consisting of a thermoplastic film; and (2) a dye image-receiving layer formed on a front surface of the front layer of the substrate sheet and comprising a dye-receiving resin material, said biaxially oriented thermoplastic film for the front layer of the substrate sheet having a multilayered structure, and the front surface of the front layer having a Bekk smoothness of 1000 seconds or more and a glossiness of 50% or less.

2. The thermal transfer dye image-receiving sheet as claimed in claim 1, wherein the thermoplastic film comprises at least one member selected from polyolefin resins and polyester resins.

3. The thermal transfer dye image-receiving sheet as claimed in claim 1, wherein the filler is present in an amount of 2 to 30% by volume in the thermoplastic film.

4. The thermal transfer dye image-receiving sheet as claimed in claim 1, wherein the filler comprises at least one member selected from the group consisting of finely divided calcium carbonate, clay, diatomaceous earth, titanium dioxide, aluminum hydroxide and silica each having an average particle size of 1 to 20 μm.

5. The thermal transfer dye image-receiving sheet as claimed in claim 1, wherein the core sheet has a thermal shrinkage smaller than that of the front layer at a temperature of 100° C. or more.

6. The thermal transfer dye image-receiving sheet as claimed in claim 1, wherein the dye-receiving resin material comprises at least one member selected from the group consisting of polyester resins, polycarbonate resins and vinyl chloride copolymers.

* * * * *